US005626549A

United States Patent [19]

Olschansky et al.

[11] Patent Number: 5,626,549

[45] Date of Patent: May 6, 1997

[54] PORTABLE EXERCISING SYSTEM

[75] Inventors: Brad Olschansky; Scott Olschansky, both of Smyrna, Ga.

[73] Assignee: Torso Technology, Inc., Smyrna, Ga.

[21] Appl. No.: 662,282

[22] Filed: Jun. 12, 1996

Related U.S. Application Data

[60] Continuation of Ser. No. 294,578, Aug. 23, 1994, abandoned, which is a division of Ser. No. 97,209, Jul. 27, 1993, Pat. No. 5,372,566.

[51] Int. Cl.[6] ..... A63B 21/02

[52] U.S. Cl. ..... 482/142; 482/140; 482/91

[58] Field of Search ..... 482/140, 142, 482/124, 125, 91, 904, 130, 126, 39, 40, 49, 121, 122, 129, 907; D21/198, 191

[56] References Cited

U.S. PATENT DOCUMENTS 1,953,857 4/1934 Hunter ..... 482/140
2,046,653 7/1936 Petcoff ..... 482/140
5,372,558 12/1994 Perry et al. ..... 482/140

*Primary Examiner*—Jerome Donnelly
*Attorney, Agent, or Firm*—Morton J. Rosenberg; David I. Klein

[57] ABSTRACT

This invention directs itself to a portable exercising system (10) which includes a stabilization mechanism (24) for contact with a resistive force load applying mechanism which may be a user's feet (22) or a stationary rigid object such as a door (62). The stabilization mechanism (24) is coupled to a force load application mechanism (38) through an adjustable securement mechanism (46) which adjusts the displacement distance between the stabilization mechanism (24) and the force load application mechanism (38) in a transverse direction (30). The force load application mechanism (38) contiguously interfaces and contacts the front of the user's thighs (14) while the user's feet (22) are mounted to and hold the stabilization mechanism (24) against a base surface (18). In this manner, a wedge type force action is applied to the user and during particular exercises such as sit-up type exercises, the user isolates a particular muscle group such as the abdominal muscle group which enhances and maximizes the efficiency of a particular exercise.

2 Claims, 4 Drawing Sheets

PORTABLE EXERCISING SYSTEM

This application is a continuation of Ser. No. 08/294,578 filed on Aug. 23, 1994 now abandoned which is a divisional of Ser. No. 08/097,209 filed on Jul. 27, 1993 now U.S. Pat. No. 5,372,566 which designated the U.S.

BACKGROUND OF THE INVENTION

1. Field of the Invention

This invention pertains to portable exercising systems where the user may use such in the privacy of their own domicile. This invention pertains to portable exercising systems which isolate various muscle groups of the user during the exercising operation to maximize the effect of a particular exercise on a distinctive muscle group. More in particular, this invention relates to a portable exercising system which includes a stabilization mechanism and a force load application mechanism applying a force to the frontal surface of the thighs of a user where the stabilization mechanism and the force load application mechanism are coupled to each other by an adjustable securement mechanism. Still further, this invention relates to a portable exercising system where the stabilization mechanism may take the form of a longitudinally extending rod or bar member held in a stabilized manner by the feet of the user with the adjustable securement mechanism passing between the legs of the user and secured on opposing ends to both the stabilization mechanism and the force load application mechanism. Note in particular, this invention relates to a portable exercising system which includes an adjustable securement mechanism which allows adjustability of the distance between the stabilization mechanism and the force load application mechanism dependent upon the particular physiology and dimensions of a particular user. More in particular, this invention relates to a portable exercise system where the force load application mechanism is in the form of a yoke shaped longitudinally extending rod having a resilient covering member for interfacing with the frontal surface areas of the thighs of a user. Still further, this invention pertains to a portable exercising system where a wedge type action force is applied to the body of a user while using such on a base surface to isolate particular muscle groups during an individual exercise operation.

2. Prior Art

Prior art portable exercising systems are known in the art. Additionally, prior art systems to aid in exercising abdominal muscles are also well known. Exercises such as sit-ups, leg raises, Roman chair sit-ups, spot reducing and a number of other exercises have been introduced in order to exercise the abdominal muscles. However, in many prior art abdominal exercising systems, the user's feet are mounted, located or hooked under a rigid element and the entire torso is lifted in an arcuate displacement. Unfortunately, this type of movement known in the prior art does not specifically address the use of the abdominal muscles in isolation. In opposition, such prior systems use the iliopsoas or hip flexor muscles running from the lower back across the pelvis and attaching to the top of the thighs. Thus, the abdominal muscles are not isolated through much of the range of the overall arcuate displacement. Opposingly, such abdominal muscles in use of such prior art systems are locked into a particular position holding the torso stable as the user displaces into a sit-up position and then into a lowering back down position. Similarly, such is true of traditional leg raises. The abdominal muscles do not attach to the legs so that when the legs are lifted, the abdominal muscles are not being used in an isolated manner. In this type of exercise and prior art system, lifting is done with the hip flexors while the abdominal muscles merely stabilize the upper body.

In such prior art systems, the abdominal muscles are not isolated and other muscles associated with the legs, knees, hips and feet are incorporated into the exercise which diminishes the loading applied to the abdominal muscles and the isolation thereof.

SUMMARY OF THE INVENTION

A portable exercising system which includes a stabilization mechanism for releasably securing the portable exercising system to a resistive force load applying member. The portable exercising system further includes a force load application mechanism which is coupled to and transversely displaced from a stabilization mechanism for application of the resistive force load to a particular body portion of a user. The portable exercising system also includes a mechanism for adjustably securing the stabilization mechanism and the force load application mechanism each to the other at a predetermined and adjustable transverse displacement distance therebetween.

DESCRIPTION OF THE PREFERRED EMBODIMENTS

Figure 1:
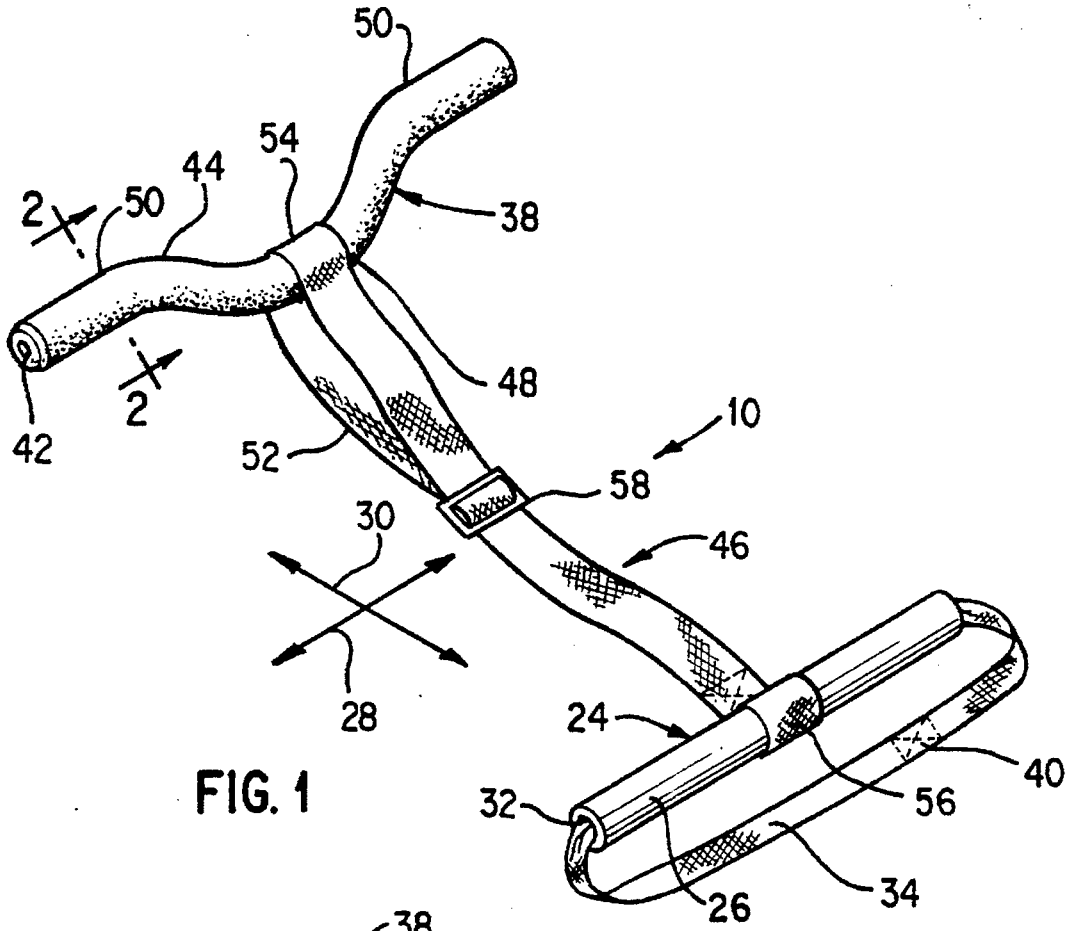
FIG. 1 is a perspective view of the portable exercising system of the subject invention concept.
Figure 1A:
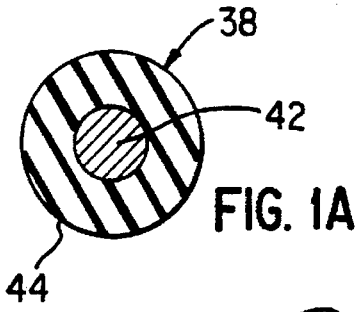
FIG. 1A is a cross-sectional view of the force load application mechanism taken along the section line 2—2 of FIG. 1.

Referring now to FIGS. 1–7, there is shown portable exercising system 10 which is adaptable to a wide range of exercises for isolating particular muscle groups of a user's body. Portable exercising system 10 is of particular advantage when user 12 is doing an exercise commonly referred to as sit-ups. However, portable exercising system 10 has a wide range of applications and advantages over prior art systems for numerous types of exercises that user 12 may accomplish in the comfort of their own domicile. As will be explained in following paragraphs, portable exercising system 10 provides for an interface with the front of thigh 14 of user 12 and acts as a wedge to drive the user's hips 16 into base surface 18. This has the effect of stabilizing the user's gluteus 20 and waist area and advantageously isolates the abdominal muscles of user 12 during a sit-up displacement. In prior art systems of the type herein referred the user generally had to wrap their feet under an element with their knees passing over another exercising element which placed the user's legs into a taut, strained and unrelaxed position. With the placement of such elements such forced the user to use their legs to help perform a sit-up exercise wherein it is the elimination of the leg usage from the sit-up which isolates the abdominal muscles of the subject invention concept.

Figure 2:
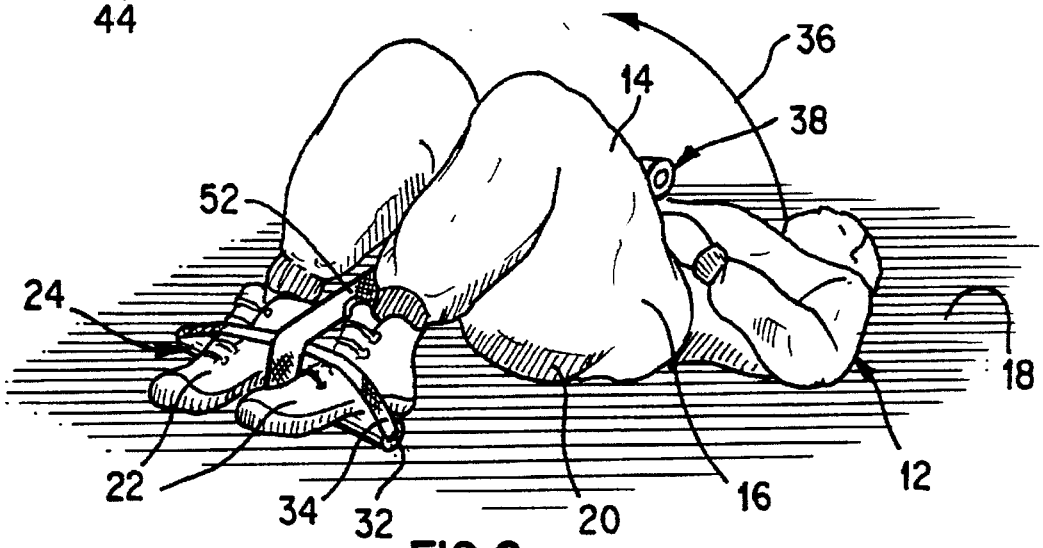
FIG. 2 is a perspective view of the portable exercising system being initially located adjacent the frontal thighs of a user lying on a base surface.
Figure 3:
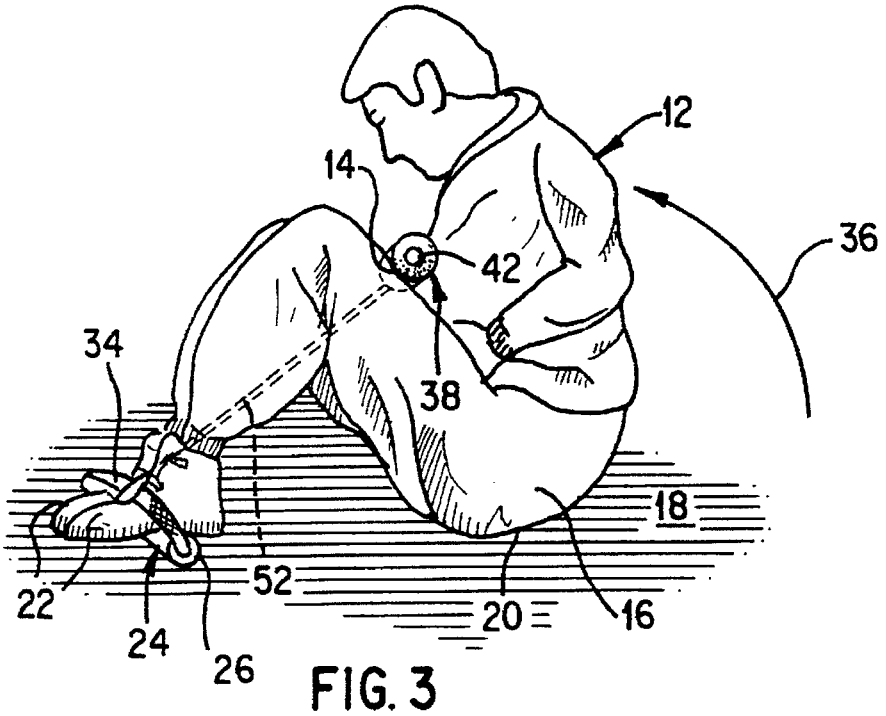
FIG. 3 is an elevational view of the portable exercising system in cooperation with a user in a sit-up position.
Figure 4:
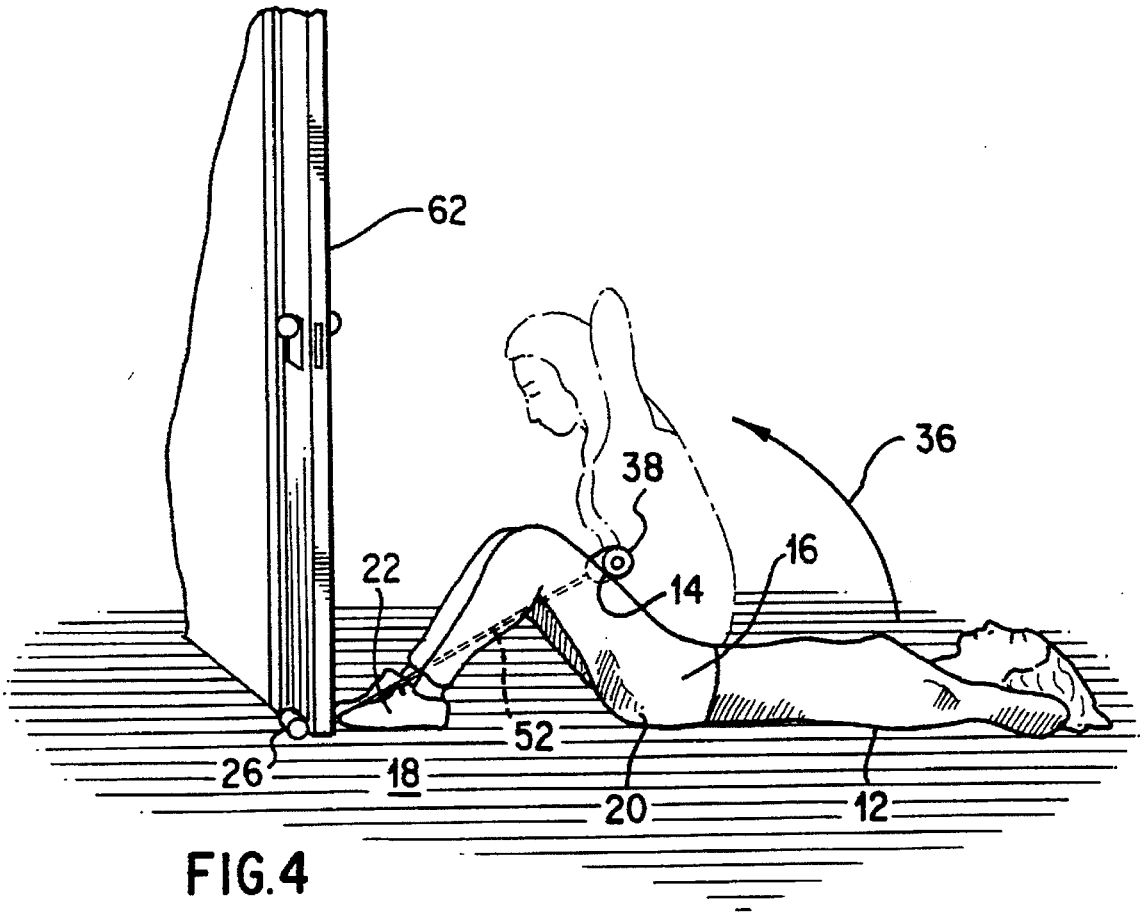
FIG. 4 is a perspective view of the portable exercising system during use in combination with a fixed stabilized member.
Figure 5:
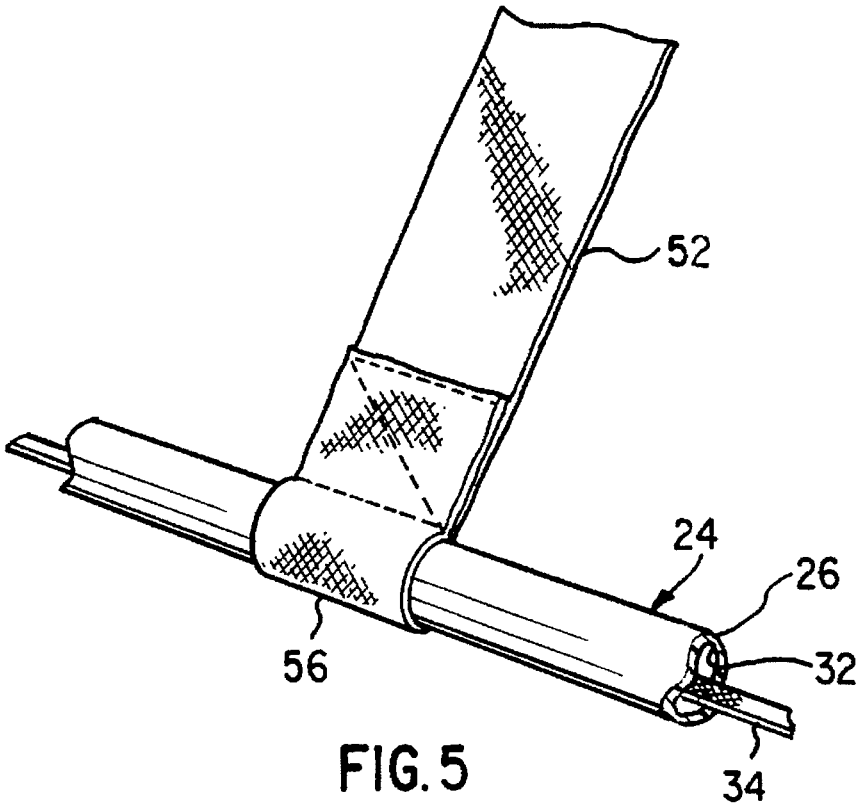
FIG. 5 is a cut-away perspective view showing the stabilization mechanism coupled to the adjustable securement mechanism.
Figure 6:
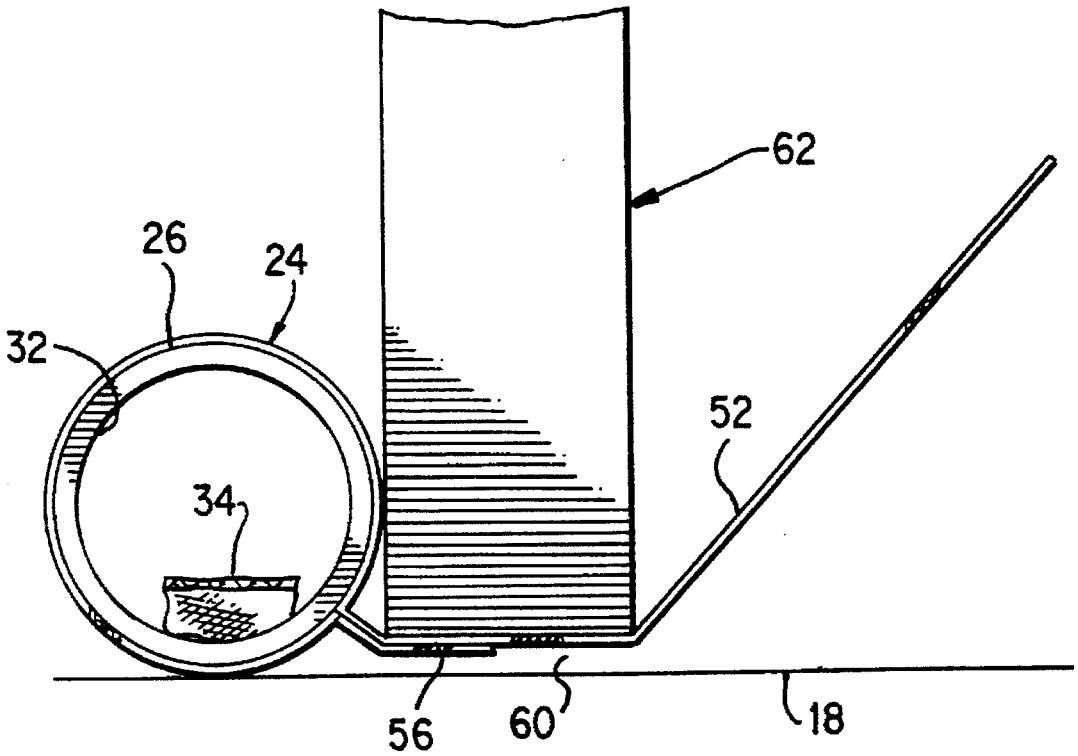
FIG. 6 is an elevational view of the portable exercising system inserted beneath a fixed stabilized member door.
Figure 7:
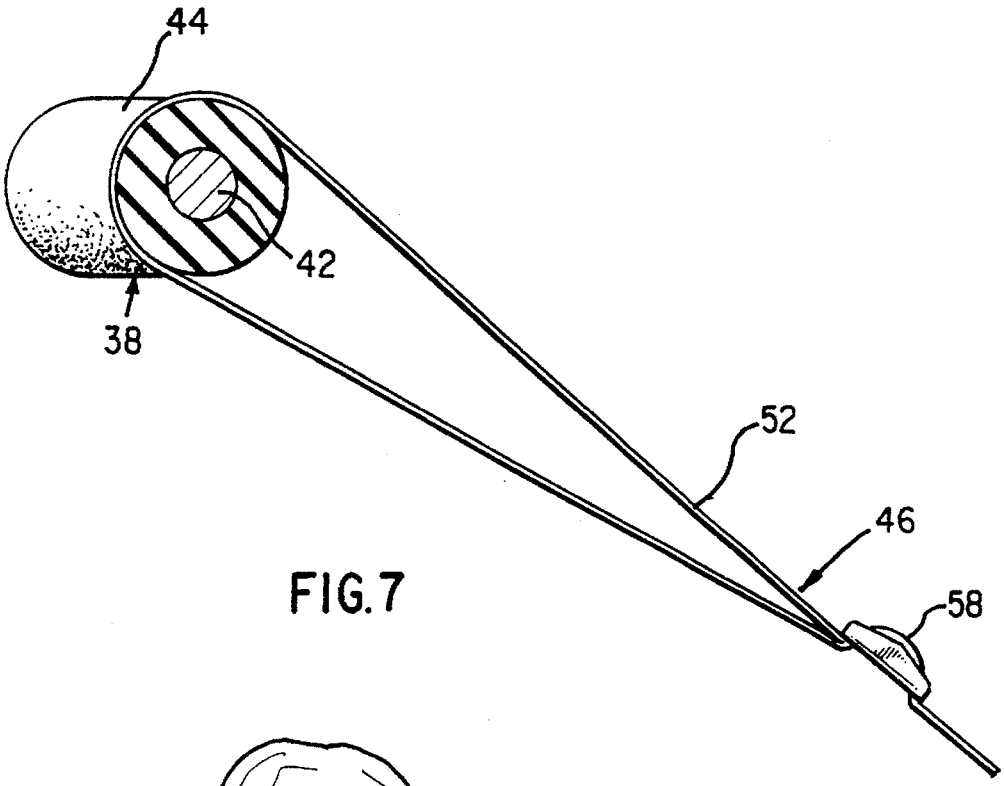
FIG. 7 is an elevational view partially cut-away of the force load application mechanism showing the strap member passing therearound; and, FIG. 8 is a perspective view of an embodiment of the subject invention concept showing a planar board member and fastening attachment member.

In this manner, user 12 has the ability of applying an exercise force to a particular muscle group which is to be exercised. Portable exercising system 10 includes stabilization mechanism 24 for releasably securing portable exercising system 10 to a resistive force load applying system. The force load applying system may be the user's feet 22 as shown in FIGS. 2 and 3 or an interface with a door 62 as is shown in FIGS. 4 and 6. Stabilization mechanism 24 includes bar member 26 extending in longitudinal direction 28 as is seen in FIG. 1. Bar member 26 includes longitudinally extending through opening 32 extending centrally through bar member 26 for passage therethrough of stabilization strap 34 which aids in stabilizing stabilization mechanism 24 when contacted by user's feet 22 as is shown in FIG. 2.

Endless stabilization strap member 34 may pass over the top of the shoes of the user and maintain some stabilization due to movement and displacement of the user in arcuate direction 36 as is seen in FIGS. 2–4. Stabilization strap member 34 may be used to maintain proper orientation of stabilization mechanism 24 during exercises where feet 22 of user 12 are essentially releasably captured between an inner surface of stabilization strap member 34 and an outer surface of longitudinally extending bar member 26. It is to be understood that portable exercising system 10 may exclude the use of stabilization strap member 34 for various exercise orientations and in particular does not have to be used in operational activity when portable exercising system 10 is applied to the interface of door 62 and base surface 18 as shown in FIGS. 4 and 6. The basic concept of strap member 34 is to promote a guiding insert and orientation capability for bar member 26 while not providing for a completely restrained type of insert enclosure for user's feet 22.

As has been stated, bar member 26 extends in longitudinal direction 28 and may be substantially circular in cross-sectional contour. However, the overall outer cross-sectional contour of bar member 26 may take a varying contour shape not important to the inventive concept as herein described with the exception that such be amenable for being used as a releasable securement of portable exercising system 10 to a resistive force load applying mechanism. Additionally, bar member 26 may be formed of a somewhat rigid material composition such as wood, metal, or plastic, such not being important to the inventive concept as herein described with the exception that the rigidity be of sufficient nature to accept the structural loading as applied by user 12 during the exercise operations.

Stabilization strap member 34 as has been stated includes an endless contour. However, the closed contour length of stabilization strap member 34 may in some cases be accommodated by strap adjustable buckle 40 to allow the user to vary the external contour length of strap member 34. In this manner, strap member 34 may be brought into more of a contiguous type contact with user's feet 22 at the discretion of the user. Strap member 34 may be formed of a textile or plastic-like composition which is flexible in nature to accommodate differing contours of user's feet 22. Strap buckle 40 may be one of a number of well known buckle type mechanisms which are commercially available.

Portable exercise system 10 includes force load application mechanism 38 which is coupled to and transversely displaced from stabilization mechanism 24 for application of resistive force loading to a body portion of user 12. As can be clearly seen in FIG. 1, force load application mechanism 38 is displaced from stabilization mechanism 24 in transverse direction 30. Force load application mechanism 38 includes longitudinally extended body interfacing rod member 42 for application of resistive force loads to a body portion of user 12 transmitted from stabilization mechanism 24 through adjustable securement mechanism 46 to force load application mechanism 38.

Adjustable securement mechanism 46 provides a mechanism for securing and coupling stabilization mechanism 24 and force load application mechanism 38 each to the other at a predetermined and adjustable transverse displacement distance in transverse direction 30 therebetween, Body interfacing rod member 42 is encompassed by resilient cover member 44 as is shown in FIGS, 1–7, Resilient cover 44 may be formed of a plastic-like composition material such as an open cell polyurethane. Cover member 44 is formed to comfortably interface with body portions of user 12 in order to provide a more comfortable force loading area on the user's particular body portion being loaded.

Body interfacing rod member 42 as well as cover member 44 include a substantially yoke-shaped contour having centrally located arch portion 48. Arch portion 48 is centrally located with longitudinally displaced end section portions 50 which extend in substantially longitudinal direction 28 and are formed in one-piece formation to central arch portion 48, Arch portion or section 48 provides a mechanism for longitudinally centering adjustable securement mechanism 46 to force load application mechanism 38 when resistive force loading is applied. Adjustable securement mechanism 46 may be slidably mounted on the exterior surface of cover member 44 and when load is applied in tension between stabilization mechanism 24 and force load application mechanism 38, adjustable securement mechanism 46 is slidably displaced to centrally located arch section 48.

Adjustable securement mechanism 46 essentially couples stabilization mechanism 24 to force load application mechanism 38 during operational use by user 12. Adjustable securement mechanism 46 includes force load strap member 52 which has opposingly located first end 54 and second end 56. Strap member second end 56 is secured to a central portion of bar member 26 and may be fixedly secured thereto through adhesive bonding or heat sealable coupling.

First end 54 of force load strap member 52 may be in a loop form passing over an exterior surface of force load application mechanism 38 and in particular cover member 44 and may be slidably coupled thereto. Additionally, adjustable securement mechanism 46 includes force load strap buckle mechanism 58 secured to force load strap member 52 for adjusting the transverse displacement between force load application mechanism 38 and stabilization mechanism 24. Obviously, users 12 have different physiologies and the dimensional displacement between stabilization mechanism 24 and force load application mechanism 38 will vary in accordance with differing physiologies of different users 12.

In operational use, and only for illustrative purposes, a sit-up type operational method will be described in following paragraphs. Initially, user 12 as is shown in FIGS. 2 and 3 may lie on a base surface 18 in a comfortable position with the user's legs bent at a comfortable angle as is shown in FIG. 2.

The length of the displacement between force loading application mechanism 38 and stabilization mechanism 24 may be adjusted through use of force load strap buckle mechanism 58 to maintain a tautened condition on force load strap member 52 when force load application member mechanism 38 is mounted on a frontal surface of the user's thighs 14 and stabilization mechanism 24 is maintained contiguous base surface 18 with the user's feet 22 mounted thereon as is shown in both FIG. 2 and FIG. 3. Strap member 52 is positioned between the legs of user 12 as is shown and as user 12 is displaced in arcuate direction 36 it is seen that force is applied to the frontal surface of user thighs 14 which causes a wedging action driving the user's gluteus into contact with base surface 18 and essentially isolating the abdominal muscles of user 12 to obtain a maximum exercising effect.

As is seen in FIGS. 4 and 6, bar member 26 may be inserted beneath door 62 and the door closed. Strap 52 passes through door clearance area 60 and constraint securement is provided by the fact that bar member 26 has a diameter greater than the width of door clearance area 60. In this case, user 12 may place their feet 22 against an inner surface of door 62 and may then displace themselves in arcuate direction 36 to provide substantially the same type of wedging action as provided in FIGS. 2 and 3. In this manner, the user once again isolates the abdominal muscles and provides for maximum exercising efficiency for this particular muscle group.

Figure 8:
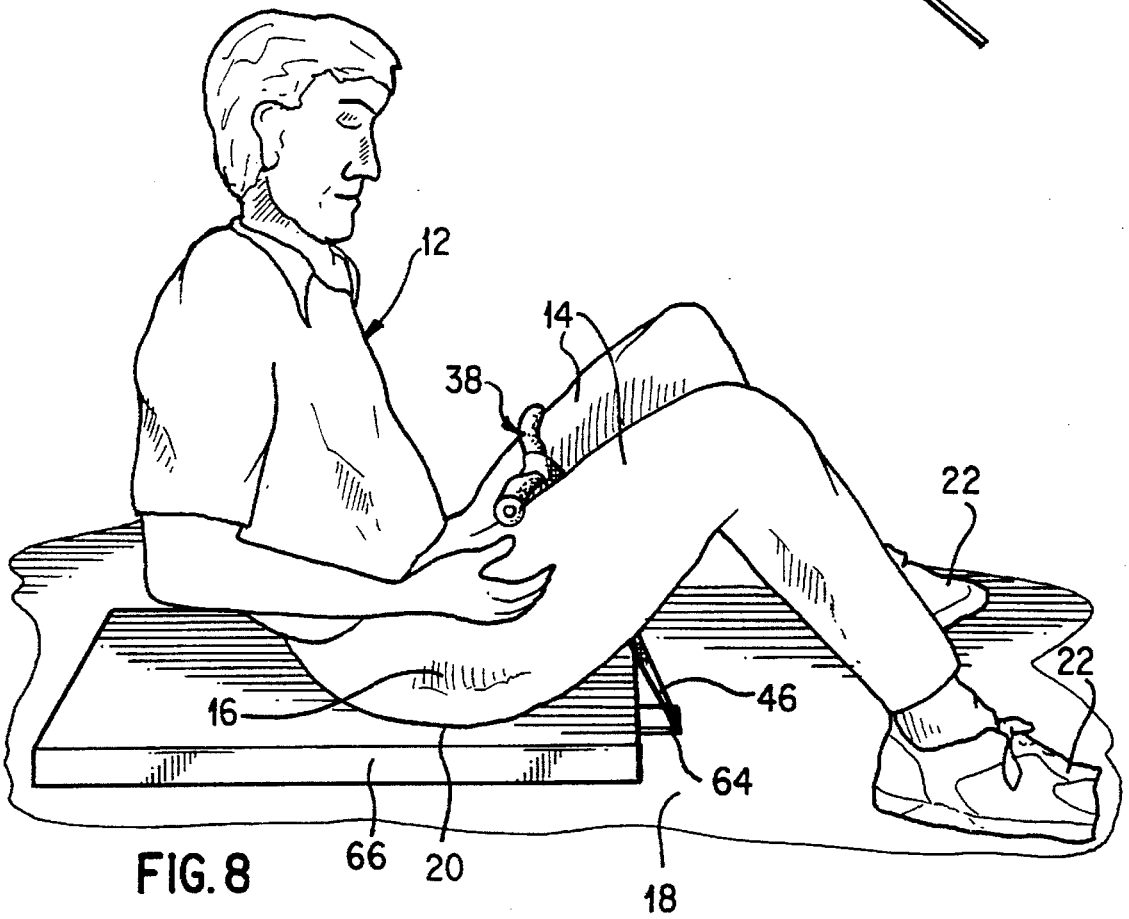

Referring now to FIG. 8, there is shown an embodiment of portable exercising system 10 which operates under the same basic wedging action as previously described however utilizes planar board member 66 for interfacing with base surface 18. User 12 sits on planar board member 66 with his gluteus 20 contiguous an upper surface of board member 66. User's feet 22 rest on base surface 18 and force load application mechanism 38 is mounted on the frontal surface of thighs 14 as previously described for the embodiments of FIGS. 1–7. Peg or lug member 64 extends from a frontal surface of planar board member 66 having attached strap member second end 56. Strap member second end 56 may be releasably mounted in a loop fashion over peg member 64 or alternatively may be fixedly secured through adhesive bonding or some like technique not important to the inventive concept as herein described.

In this embodiment, planar board member 66 becomes the resistive force load applying mechanism as previously described. The wedging action is maintained through interface of force load application mechanism 38 end sections 50 on the frontal surface area of user thighs 14. The overall dimension of planar board member 66 is not important to the inventive concept with the exception that such be of sufficient surface area to accept the gluteus region 20 of user 12 and optimally allow a portion of the user's back to be contiguously located when the user is lying flat.

Peg member 64 may be mounted through insert of an opening formed through a frontal surface of planar board member 66 or otherwise may be fixedly attached.

Although this invention has been described in connection with specific forms and embodiments thereof, it will be appreciated that various modifications other than those discussed above may be resorted to without departing from the spirit or scope of the invention. For example, equivalent elements may be substituted for those specifically shown and described, certain features may be used independently of other features, and in certain cases, particular locations of elements may be reversed or interposed, all without departing from the spirit or scope of the invention as defined in the appended claims.

What is claimed is:

1. A portable exercising system comprising:

(a) means for applying a resistive force load to a user, resistive force load applying means including a longitudinally extended planar board member having opposing upper and lower sides and longitudinally opposed frontal and rear end surf, said upper side for engaging a gluteus portion of a user's body and said lower side being adapted to rest upon a base surface;

(b) stabilization means coupled to said resistive force load applying means for coupling said resistive force load applying means to said planar board member, said stabilization means including a fastening member secured to and extending beyond said frontal end surface and;

(c) force load application means coupled to said fastening member in longitudinally and angularly spaced relationship, said force load application means for engaging a thigh portion of a user's body oriented in non-parallel relationship with said planar board member for application of said resistive force load thereto, said force load application means including a rod member and means for adjustably securing said rod member and said fastening member each to the other at a predetermined and adjustable longitudinal displacement distance therebetween, said force load application means including a substantially inelastic length adjustable strap member coupled on opposing ends to said rod member and said stabilization means.

2. The portable exercising system as recited in claim 1 where said fastening member is a peg member secured to said frontal end surface of said planar board member.

* * * * *